US005397486A

United States Patent [19]

Small

[11] Patent Number: 5,397,486

[45] Date of Patent: Mar. 14, 1995

[54] LUBRICATING OIL COMPOSITIONS FOR RAILROAD DIESEL ENGINES

[75] Inventor: Vernon R. Small, Rodeo, Calif.

[73] Assignee: Chevron Chemical Company, San Francisco, Calif.

[21] Appl. No.: 99,632

[22] Filed: Jul. 30, 1993

[51] Int. Cl.[6] ..... C10M 129/00

[52] U.S. Cl. ..... 252/42.7; 252/48.2; 252/51.5 R; 252/52 A

[58] Field of Search ..... 252/42.7, 52 A, 52 R, 252/48.2, 32.7 E, 51.5 R

[56] References Cited

U.S. PATENT DOCUMENTS

| | | | |
|---|---|---|---|
| 2,795,548 | 6/1957 | Thomas et al. | 252/49.6 |
| 3,711,406 | 1/1973 | Lowe | 252/33.4 |
| 3,779,920 | 12/1973 | Devries | 252/33.4 |
| 3,919,093 | 11/1975 | Davis et al. | 252/31 |
| 3,933,662 | 1/1976 | Lowe | 252/33.4 |
| 3,933,663 | 1/1976 | Lowe | 252/33.4 |
| 4,138,347 | 2/1979 | Crawford | 252/33 |
| 4,384,967 | 5/1983 | Salentine et al. | 252/48.4 |
| 4,394,276 | 7/1983 | Small | 252/32.7 E |
| 4,394,277 | 7/1983 | Small, Jr. | 252/32.7 |
| 4,402,845 | 9/1983 | Zoleski et al. | 252/52 A |
| 4,464,276 | 8/1984 | Sung et al. | 252/42.7 |
| 4,479,882 | 10/1984 | Zoleski et al. | 252/33.4 |
| 4,493,776 | 1/1985 | Rhodes | 252/25 |
| 4,734,211 | 3/1988 | Kennedy | 252/51.5 A |
| 4,764,296 | 8/1988 | Kennedy | 252/334 |
| 4,820,431 | 4/1989 | Kennedy | 252/56 R |
| 4,849,118 | 7/1989 | Stauffer et al. | 252/47 |
| 4,871,465 | 10/1989 | Hutchison | 252/47 |
| 4,948,523 | 8/1990 | Hutchison et al. | 252/47 |
| 5,244,591 | 9/1993 | Middleton | 252/48.6 |

FOREIGN PATENT DOCUMENTS

| | | |
|---|---|---|
| 792960 | 6/1973 | Belgium . |
| 56-141394 | 11/1981 | Japan . |
| 2109403A | 6/1983 | United Kingdom . |

*Primary Examiner*—Stephen Kalafut
*Assistant Examiner*—Cephia D. Toomer
*Attorney, Agent, or Firm*—L. S. Squires; W. K. Turner

[57] ABSTRACT

Disclosed are lubricating oil compositions for use in 2-cycle railroad diesel engines having silver surfaced engine parts, which composition comprises an effective amount of a silver wear inhibiting compound. A method for inhibiting wear of silver-surfaced parts in railroad engines and a drive train of a two-cycle railroad diesel engine comprising silver wrist-pin bearings and the lubricating oil composition comprising the wear-inhibitor are also disclosed.

17 Claims, No Drawings

LUBRICATING OIL COMPOSITIONS FOR RAILROAD DIESEL ENGINES

BACKGROUND OF THE INVENTION

1. Field of the Invention

This invention is directed to lubricating oil compositions for use in railroad diesel engines having silver-surfaced engine parts and to methods for reducing wear of such silver-surfaced engine parts by use of such lubricating oil compositions.

2. State of the Art

Heavy duty diesel engines, such as railroad diesel engines, require crankcase lubricating oils which are stabilized against oxidation and which suspend combustion products. Combustion products lead to the formation of deposits in engines and the formation of sludge and varnish on pistons, cylinders, cylinder liners, and undercrown cavities. The diesel crankcase lubricant, in particular, should also prevent carbon deposition in the engine, especially in the top ring piston groove.

Railroad diesel engines and marine diesel engines are both heavy duty diesel engines. The internal components and operating conditions of these engines are, however, quite different. For example, two cycle railroad diesel engines are characterized by and distinguished from marine diesel engines by many factors including the presence of silver wrist-pin bearings which are operated under constant, extreme pressure lubricating conditions wherein these bearings operate to facilitate translation of the vertical movement of the pistons to circular movement of the crankshaft.

The use of a silver coating in the wrist-pin bearings is due to the fact that this metal imparts superior advantages in wear resistance to the bearing when operated under such extreme conditions. In contrast, marine engines of the cross-head type do not require silver coating of any of their internal parts.

As a further distinction, in railroad diesel engines, the lubricating oil composition is maintained in a sump and, during operation, this oil is constantly cycled to lubricate the internal parts of the engine. Contrarily, in marine diesel engines of the cross-head type, the lubricating oil composition employed to lubricate the piston ring-liner interface is kept separate from the sump and is employed as a "once through" oil.

In view of the differences in internal components and operating conditions existing between marine and railroad diesel engines, the lubricating oil composition requirements for these two types of diesel engines are also quite different. For example, marine diesel engines use an SAE 50 grade marine cylinder lubricant (MCLs), while railroad diesel engines use an SAE 40 grade lubricant. In addition, marine diesel engines burn fuel containing up to 4% sulfur (the OEM requirement) and thus require crankcase lubricating oils having a high alkalinity (on the order of 50–100 TBN) in order to neutralize acids formed during fuel combustion. By contrast, railroad diesel engines burn fuel having no more than about 0.5 weight percent sulfur and, therefore, require lubricating oils having a significantly lower alkalinity, i.e., a TBN generally of about 5 to 30, which is also employed to neutralize acids generated during fuel combustion.

In general, a TBN of from 5 to 30 for railroad lubricating oil compositions is achieved by inclusion of a requisite amount of a calcium overbased sulfurized alkylphenate. However, the inclusion of this highly overbased alkylphenate is detrimental to use in railroad diesel engines as it imparts undesirable wear to the silver coating on the silver wrist-pin bearings.

The art has recognized this problem and, heretofore, silver corrosion in railroad diesel engines was typically inhibited by the inclusion of a corrosion inhibiting amount of a chlorinated hydrocarbon. See, for example, U.S. Pat. Nos. 4,169,799, 4,171,269, 4,320,016, 4,428,850 and 4,464,276. However, the use of chlorinated hydrocarbons is perceived to be detrimental to the environment and causes disposal problems for spent oil. As a result, chlorinated hydrocarbons and their use are increasingly becoming subject to more stringent environmental regulations.

In view of the above, it would be highly desirable to discover a non-chlorinated lubricating oil additive which protects silver-surfaced diesel engine parts from wear and thereby permit the formulation of a lubricating oil composition suitable for railroad diesel engine use which composition is free of chlorinated hydrocarbons.

While the art has provided some examples of non-chlorinated additives which inhibit silver corrosion (e.g., U.S. Pat. Nos. 4,764,296, 4,734,211, and 4,820,431), additional additives which would inhibit silver wear in railroad diesel engines would be advantageous.

This invention is directed to the discovery that certain lubricating oil soluble hydrocarbyl polyoxyalkylene compounds are especially useful in inhibiting silver wear in railroad diesel engines. In this regard, it is noted that polyoxyalkylene compounds have been used as lubricating oil additives in compositions for use in the upper cylinder chamber of marine diesel cylinder engines of the crosshead type. For example, U.S. Pat. No. 4,402,845 discloses lubricant compositions having a TBN of from 50 to 100 which are used in marine diesel cylinder engines of the crosshead type and which contain a polyethylene glycol compound of the formula:

$$R—CH_2O—(CH_2CH_2O)_nH$$

wherein n ranges from 7 to 40 and R is an alkyl group containing from 11 to 15 carbon atoms. These compounds are disclosed as improving the spreadability of marine diesel engine cylinder oils after injection of the oil into the interior of the cylinder chamber. In column 2, line 40 of the patent, TERGITOL ® 15-S-20 is cited as a particularly preferred compound.

Similarly, U.S. Pat. No. 4,479,882 discloses a process for improving the spreadability of a lubricating oil composition having a TBN of from 50 to 100 for use in a marine diesel engine of the crosshead type by incorporating therein of a polyalkoxylated phenoxy compound of the formula:

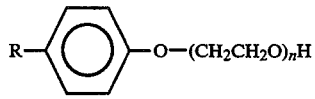

wherein R is an aliphatic hydrocarbyl group having from 5 to 70 carbon atoms and n ranges from 14 to 30.

However, there is apparently no disclosure of using such polyoxyalkylene compounds or other hydrocarbyl polyoxyalkylene compounds of the type described herein below in railroad diesel engines for any purpose let alone for the purpose of inhibiting silver wear.

SUMMARY OF THE INVENTION

This invention is based, in part, on the discovery that certain hydrocarbyl polyoxyalkylenes and hydrocarbyl glycidol derivatives are effective inhibitors of silver wear when used in two cycle railroad diesel engine lubricating oil compositions, especially in railroad diesel engines containing silver-surfaced parts, e.g., silver wrist-pin bearings.

Accordingly, in one of its method aspects, this invention is directed to a method for inhibiting wear of silver wrist-pin bearings in a two-cycle railroad diesel engine which method comprises lubricating the internal portion thereof with a lubricating oil composition which comprises:

a single or multi-grade oil of lubricating viscosity;

a sufficient amount of a calcium overbased sulfurized alkylphenate composition so that the total base number in the lubricating oil composition is from about 5 to about 30; and a wear-inhibiting amount of at least one lubricating oil soluble and compatible compound selected from the group consisting of compounds of formula I $$R—X—[(R_1O—)_nH]m \qquad \text{I}$$

of formula II $$R—X—CH_2\overset{\overset{\displaystyle OH}{|}}{C}HCH_2OH \qquad \text{II}$$

of formula III $$R—X—CH\begin{cases}CH_2OH\\CH_2OH\end{cases} \qquad \text{III}$$

and products obtained by reacting the compounds of formula II and III with from 1 to 30 equivalents of a compound selected from the group consisting of alkylene oxide of from 2 to 6 carbon atoms, glycidol and mixtures thereof under conditions resulting in formation of an alkylene oxide and/or glycidol adduct of the compounds of formula II and III wherein R is a hydrocarbyl radical having from about 4 to about 50 carbon atoms; $R_1$ is independently an alkylene group of from about 2 to about 6 carbon atoms; X is selected from the group consisting of oxygen, sulfur and nitrogen, preferably oxygen; n is an integer from 1 to about 30, preferably 10 to 20; m is 1 when X is oxygen or sulfur and is 1 or 2 when X is nitrogen; and with the proviso that when $R_1$ is ethylene, then the oil of lubricating viscosity is a single grade oil.

In one of its article of manufacture aspects, this invention is directed to a drive train of a two-cycle railroad diesel engine comprising silver wrist-pin bearings and a lubricating oil composition comprising:

a single or multi-grade oil of lubricating viscosity to provide for a 40 SAE viscosity grade lubricating oil composition;

a sufficient amount of a calcium overbased sulfurized alkylphenate composition so that the total base number of the lubricating oil composition is from about 5 to about 30; and a wear-inhibiting amount of at least one lubricating oil soluble and compatible compound selected from the group consisting of compounds of formula I $$R—X—[(R_1O—)_nH]_m \qquad \text{I}$$

of formula II $$R—X—CH_2\overset{\overset{\displaystyle OH}{|}}{C}HCH_2OH \qquad \text{II}$$

of formula III $$R—X—CH\begin{cases}CH_2OH\\CH_2OH\end{cases} \qquad \text{III}$$

and products obtained by reacting the compounds of formula II and III with from 1 to 30 equivalents of a compound selected from the group consisting of alkylene oxide of from 2 to 6 carbon atoms or glycidol under conditions resulting in formation of an alkylene oxide and/or glycidol adduct of the compounds of formula II and III wherein R is a hydrocarbyl radical having from about 4 to about 50 carbon atoms; $R_1$ is independently an alkylene group of from about 2 to about 6 carbon atoms; X is selected from the group consisting of oxygen, sulfur and nitrogen, preferably oxygen; n is an integer from 1 to about 30, preferably 10 to 20; m is 1 when X is oxygen or sulfur and is 1 or 2 when X is nitrogen; and with the proviso that when $R_1$ is ethylene, then the oil of lubricating viscosity is a single grade oil.

This invention is also directed to the lubricating oil compositions described in the above methods and articles of manufacture.

In a preferred embodiment of the abovedescribed methods, articles of manufacture, and lubricating oil compositions the hydrocarbyl group, R, of the compounds of formula I and II above is an alkyl, an aryl or an alkaryl hydrocarbyl radical. More preferably, when R is an alkyl group, it is branched at the point of attachment of the polyoxyalkylene moiety to the alkyl group, especially for polyoxyethylene moieties.

In a further preferred embodiment of the abovedescribed methods, articles of manufacture, and lubricating oil compositions, the compounds of formula II above are glycerol derivatives of the formula $$R—X—CH_2\overset{\overset{\displaystyle OH}{|}}{C}HCH_2OH \quad \text{and} \quad R—X—CH(CH_2OH)_2.$$

In another preferred embodiment, the hydrocarbyl polyoxyalkylene compounds of formula I above are a mixture of alkyl polyoxyethylenes of the general formula:

$$C_{11\text{-}15}H_{23\text{-}31}O[(CH_2CH_2O)_nH]_m$$

wherein n is 12 and m is 1, with the proviso that the $C_{11\text{-}15}H_{23\text{-}31}$ group is attached to the oxygen group via a secondary carbon atom (i.e., >CH—O—) or a tertiary carbon atom (i.e.,

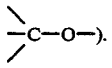

In still another preferred embodiment, the wear-inhibiting amount of at least one hydrocarbyl polyoxyalkylene compound is preferably from about 0.1 and about 5.0 weight percent based on the total weight of the lubricating oil composition and, more preferably, from about 0.3 and about 1.0 weight percent based on the total weight of the lubricating oil composition.

The lubricating oil composition described herein preferably further comprises one or more additional additives such as, by way of example, alkenyl succinimides, anti-rust agents, and the like. However, such formulated lubricating oil compositions do not typically contain added zinc dithiophosphate, sulfur and alkaline earth metal carbonates. Preferably, such compositions also do not contain neutral or overbased Group II metal hydrocarbyl sulfonates.

DETAILED DESCRIPTION OF THE PREFERRED EMBODIMENTS

This invention is directed to a novel method for inhibiting silver wear of silver wrist-pin bearings in a two-cycle railroad diesel engine. This method comprises lubricating the internal portion of the engine with lubricating oil compositions which comprise a single or multi-grade oil of lubricating viscosity and a wear-inhibiting amount of at least one compound of formula I, II and III above. Such compounds surprisingly inhibit wear of the silver-surfaced parts in railroad diesel engines (e.g., silver wrist-pin bearings) when the internal portions thereof are lubricated with lubricating oil compositions containing an effective amount of at least one such compound.

However, prior to describing this invention in further detail, the following terms will first be defined.

Definitions

As used herein, the term "Total Base Number" or "TBN" refers to the amount of base equivalent in milligrams of KOH in 1 gram of additive. Thus, higher TBN numbers reflect more alkaline products and therefore a greater alkalinity reserve. The Total Base Number for an additive composition is readily determined by ASTM test method D2896 or other equivalent methods.

The term "hydrocarbyl poly(oxyalkylene) compounds" or "hydrocarbyl-terminated poly(oxyalkylene) compounds" refers to monohydroxy compounds, i.e., alcohols, often termed monohydroxy polyethers, or polyalkylene glycol monohydrocarbyl-ethers, or "capped" poly(oxyalkylene)glycols and are to be distinguished from poly(oxyalkylene)glycols which are not hydrocarbyl-terminated, i.e., are not capped. The hydrocarbyl poly(oxyalkylene) alcohols are produced by the addition of lower alkylene oxides, such as oxirane, ethylene oxide, propylene oxide, the butylene oxides, or the pentylene oxides to the hydroxy compound RXH under polymerization conditions, wherein R and X are as defined above. Methods of production and properties of these polymers are disclosed in U.S. Pat. Nos. 2,841,479 and 2,782,240, and Kirk-Othmer's "Encyclopedia of Chemical Technology", vol. 19, p. 507, which are incorporated herein by reference in their entirety. In the polymerization reaction, a single type of alkylene oxide may be employed, e.g., propylene oxide, in which case the product is a homopolymer, e.g., a poly(oxypropylene)propanol. However, copolymers are equally satisfactory and random copolymers are readily prepared by contacting the hydroxyl-containing compound with a mixture of alkylene oxides, such as a mixture of propylene and butylene oxides. Block copolymers of oxyalkylene units also provide satisfactory poly(oxyalkylene) polymers for the practice of this invention.

In general, the poly(oxyalkylene) polymers are mixtures of compounds that differ in polymer chain length. However, their properties closely approximate those of the polymer represented by the average composition and molecular weight of the poly(oxyalkylene) polymer mixture.

The hydrocarbyl group of the hydrocarbyl-terminated poly(oxyalkylene) compounds contain from about 4 to about 50 carbon atoms and, preferably, from about 6 to about 20 carbon atoms. The oxyalkylene units of the poly(oxyalkylene) moiety of the hydrocarbyl-terminated poly(oxyalkylene) compounds contain from about 2 to about 6 carbon atoms and, preferably, from about 2 to about 4, and, most preferably, from 2 to 3 carbon atoms. In addition, the average molecular weight of the hydrocarbyl poly(oxyalkylene) compound is preferably between about 120 and about 3500, more preferably between about 200 and about 2000. Each poly(oxyalkylene) polymer contains from 1 to 30 oxyalkylene units, preferably 10 to 20 units. In general, the oxyalkylene units may be branched or unbranched. Preferably the poly(oxyalkylene) polymer chain contains some ethylene units.

The term "hydrocarbyl" refers to an organic radical composed of carbon and hydrogen which may be aliphatic, alicyclic, aromatic or combinations thereof, i.e., aralkyl. The hydrocarbyl radical may have a straight- or branched-chain of carbon atoms. When the hydrocarbyl radical is an alkyl group, then the alkyl group preferably has a branched-chain carbon atom directly adjacent to the oxygen, nitrogen or sulfur X moiety especially when the $R_1$ group is ethylene. In addition, the hydrocarbyl radical will preferably be relatively free of aliphatic unsaturation, i.e., ethylenic and acetylenic, particularly acetylenic unsaturation. The hydrocarbyl radical is generally derived from a monofunctional compound (RXH). Such monofunctional compounds are preferably derived from aliphatic or aromatic alcohols, thiols, and amines, and more preferably are derived from alkanols or alkylphenols.

Methodology

A. Hydrocarbyl Polyoxyalkylene Compounds

The hydrocarbyl polyoxyalkylene compounds of formula I above are obtained by reacting a suitable alkylene oxide with an RXH compound, wherein R and X are as defined above. In general, sufficient alkylene oxide is employed to provide for polyoxyalkylene polymers containing, on average, at least one oxyalkylene unit, preferably from 1 to about 30 units, more preferably, from about 5 to about 30 units, and most preferably from about 10 to about 25 oxyalkylene units.

When polymerized in the polymerization reaction, a single type of alkylene oxide may be employed. Copolymers, however, are equally satisfactory and random copolymers are readily prepared. Blocked copolymers of oxyalkylene units also provide satisfactory polyoxyalkylene polymers for the practice of the present invention.

As noted above, the polyoxyalkylene moiety is terminated or "capped" by a hydrocarbyl terminating group. This terminating group may be comprised of an alkyl group of from about 4 to about 50 carbon atoms, an aryl group of from about 6 to about 50 carbon atoms, an alkaryl group of from about 7 to about 50 carbon atoms, an aralkyl group of from about 7 to about 50 carbon atoms, a methylol-substituted group of from about 7 to about 50 carbon atoms, and the like.

The polyoxyalkylene polymer may ordinarily be prepared in a variety of ways, the most common for the practice of the present invention being by the reaction of an appropriate lower alkylene oxide containing from about 2 to about 6 carbon atoms with an appropriate initiator, for example, an alkanol or an alkyl phenol. Copolymers may be readily prepared by contacting the initiator compound with a mixture of alkylene oxides while the blocked copolymers may be prepared by reacting the initiator first with one alkylene oxide and then another in any order or repetitively under polymerization conditions.

In addition, many of the hydrocarbyl polyoxyalkylene compounds which find use in this invention are commercially available. For example, a preferred group of such compounds is sold commercially under the name TERGITOL ® by Union Carbide Chemicals and Plastics Company Inc., Danbury, Conn. 06817. These additives are described in that company's brochure "Tergitol Surfactants," published in Sep. 1975. A particularly preferred additive is TERGITOL ® 15-S-12, which is believed to be a mixture of secondary alcohols reacted with ethylene oxide having the general formula:

$$C_{11\text{-}15}H_{23\text{-}31}O[CH_2CH_2O]_nH$$

where n is on average 12. Other polyoxyalkylene analogues useful in this invention include those sold under the names SIPONIC ® and ETHOMEEN ®.

It is critical, however, that the hydrocarbyl polyoxyalkylene compound employed herein is lubricating oil soluble and is compatible in the fully formulated composition. That is to say that the hydrocarbyl polyoxyalkylene compound is sufficiently soluble in a formulated lubricating oil composition to provide a wear-inhibiting amount of the compound in the oil which amount does not precipitate or cause other components in the composition to precipitate from the composition under ambient conditions (i.e., about 20°C). Preferably, the hydrocarbyl polyoxyalkylene compound is soluble and compatible to a level of at least 0.1 weight percent in the formulated composition and more preferably to a level of at least 0.3 weight percent for a period of at least about one month and preferably for a period of at least about 6 months.

Methods for determining oil solubility and compatibility for these compositions are well known in the art and precipitation from a formulated lubricating oil composition at ambient conditions is measured by either actual precipitation from the oil composition or the formation of a "cloudy" solution which evidences formation of insoluble wax particles. In this regard, it has been found that when the hydrocarbyl poly(oxyalkylene) compound of formula I is an alkyl poly(oxyethylene) compound, such compounds are not oil soluble in a multi-grade oil but can be soluble in a single-grade oil. It has been further found that the solubility of alkyl poly(oxyethylene) compounds in a single grade oil is facilitated by the use of a branched carbon atom at the point of attachment of the alkyl group to the poly(oxyethylene) group.

B. Glycidol Derivatives

The compounds of formula II and III can be prepared by methods well known in the art. For example, these compounds can be prepared by the reaction of glycidol with a compound of the formula RXH, wherein X is NH, S or O.

Glycidol is a commercially available reagent of the formula

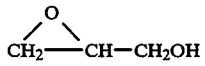

Alternatively, glycidol may be prepared from glycerol-1-monochlorohydrin by the action of potassium hydroxide in alcohol. See, for example, Rider et al, JACS, 52, 1521 (1930).

Glycidol reacts with a compound of the formula RXH, as described above, to produce either or both a hydrocarbyl 2,3-dihydroxy-1-propyl derivative, IV, or a hydrocarbyl 1,3-dihydroxy-2-propyl derivative, V, as shown in the reaction (1) below (X=O for the sake of illustration):

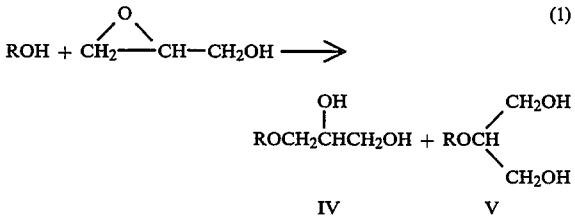

(1)

IV V wherein R is as previously described.

In general, 2,3-dihydroxyl-1-propyl derivatives are the result of nucleophilic ring opening of the epoxide group of glycidol; whereas, 1,3-dihydroxy-2-propyl derivatives are the result of electrophilic ring opening of the epoxide group of glycidol. Actual product formation from this reaction is generally a mixture of both the 2,3-dihydroxy-1-propyl and the 1,3-dihydroxy-2-propyl derivatives with the predominant product depending upon numerous factors such as solvent, catalyst and other factors well known in the art. For instance, an acid catalyst, such as p-toluene sulfonic acid, hydrogen chloride, boron trifluoride, etc., facilitates electrophilic ring opening resulting in the predominant formation of the 1,3-dihydroxy-2-propyl derivative. On the other hand, basic conditions favor nucleophilic ring opening which results in predominant formation of the 2,3-dihydroxy-1-propyl derivative.

At a charge mole ratio of 1 or less, the product mixture contains unreacted starting material, compounds of formula II and III as well as some polymerized adducts thereof. This mixture can be separated by conventional methodologies such as column chromatography, high performance chromatography, etc., to provide for the compounds of formula II and III, or alternatively, the resulting product can be used as is without separation and/or purification.

As the charge mole ratio of glycidol to RXH exceeds 1, excess glycidol then reacts with the hydroxy groups of either the 2,3-dihydroxy-1-propyl groups or the 1,3-dihydroxy-2-propyl derivatives resulting in a mixture of several products. The identity of these products are dependent on factors such as either nucleophilic or electrophilic epoxide ring opening; the degree of polymerization; addition to either the primary (more likely) or secondary (less likely) hydroxy group of the 2,3-dihydroxy-1-propyl groups; etc.

By contrast, by combining the compound of formula II and/or III with an alkylene oxide under polymerization conditions, the resulting mixture will contain products of formula VI and VII:

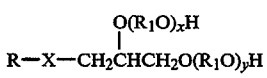

VI and of formula III

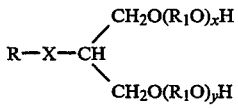

VII where x and y are integers from 0 to 30 and with the proviso that x+y is greater than zero but less than or equal to 30.

Reaction products of a mixture of glycidol and alkylene oxide can also be prepared wherein the amount of such mixtures is controlled to provide from 2 to 30 equivalents.

The addition reaction of glycidol or an alkylene oxide to RXH or to the compounds of formula IV and V above is well known in the art and is described, for example, in U.S. Pat. Nos. 4,758,451 and 4,631,070 both of which are incorporated herein by reference in their entirety. As is apparent, reactions utilizing glycidol as a reagent preferably employ either a dilute solution of glycidol or slow addition of glycidol to the reaction system in order to minimize self polymerization of the glycidol.

In any event, compounds of formula I to III and VI to VII as well as the products obtained from addition of from 1 to 30 equivalents of glycidol and/or alkylene oxide to the compounds of formula I–III provide for reduction in silver wear when employed in lubricating oils in a silver wear inhibiting effective amount.

The amount required to effect wear-inhibition for the compounds of formula I, II and III above as well as alkylene oxide and/or glycidol derivatives thereof is dependent upon a variety of factors, including the type of oil used, the presence of other additives, etc., and the specific wear-inhibiting amount of such compounds can readily be determined by the skilled artisan. However, in a preferred embodiment, the compounds of formula I, II and III above as well as alkylene oxide and/or glycidol derivatives thereof are employed in the lubricating oil composition at a concentration of from about 0.1 and about 5.0 weight percent and more preferably from about 0.3 to about 1.0 weight percent based on the total weight of the composition. Such concentrations impart silver wear inhibition to the lubricating oil composition.

C. Calcium Overbased Sulfurized AlkylPhenates

In addition to the lubricating oil soluble and compatible silver wear inhibiting compounds described above, the lubricating oil compositions described herein contain a sufficient amount of a calcium overbased sulfurized alkylphenate composition so that the total base number of the formulated lubricating oil composition is from about 5 to 30 and preferably 10 to 20. The preparation of calcium overbased sulfurized alkylphenate compositions is well known in the art and is described, for example, in U.S. Pat. Nos. 5,024,773 which is incorporated herein by reference in its entirety.

Specifically, the calcium overbased sulfurized alkylphenate composition can be prepared by reacting in an inert hydrocarbon diluent appropriate amounts of sulfur, alkylphenol, calcium oxide, hydroxide or $C_1$–$C_6$ alkoxide followed by carbonation with $CO_2$. The reaction system will also contain a $C_2$–$C_4$ alkylene glycol (such as 1,3 propylene glycol, 1,4-butylene glycol, ethylene glycol, etc., but preferably the $C_1$–$C_4$ alkylene glycol is ethylene glycol), a high molecular weight alkanol, i.e., an alkanol of at least 8 carbon atoms, and a compound selected from the group consisting of a Group II metal neutral hydrocarbyl sulfonate, an alkenyl succinimide and mixtures thereof.

The reaction can also optionally employ a sulfurization catalyst which catalyzes the sulfur incorporation onto the alkylphenol. Suitable sulfurization catalysts are disclosed in U.S. Pat. No. 4,744,921 which is incorporated herein by reference in its entirety.

In this reaction, sulfur is generally employed at from about 1.5 to 4 moles per mole of the alkylphenol in the reaction system; preferably at from about 2 to 4 moles per mole of the alkylphenol and even more preferably at from about 2 to 3 moles per mole of alkylphenol. All allotropic forms of sulfur can be used. Alternatively, in place of sulfur, sulfur monochloride may be employed. For the purposes of this invention, sulfur monochloride is considered equivalent to sulfur. The sulfur may be employed either as molten sulfur or as a solid.

The calcium oxide, hydroxide or $C_1$–$C_6$ alkoxide used to prepare the calcium overbased sulfurized alkylphenate compositions used in the lubricating oil compositions described herein is employed at a molar charge of from about 1.5 to about 4 per mole of alkylphenol; although preferably at from greater than 2 to 4; and even more preferably from greater than 2 to 3 per mole of alkylphenol.

Carbon dioxide is employed in the reaction system in conjunction with the calcium oxide, hydroxide or $C_1$–$C_6$ alkoxide to form overbased products and is generally employed from about 1 to about 3 moles per mole of alkylphenol, although preferably from about 2 to about 3 moles per mole of alkylphenol charged to the reaction system. Preferably, the amount of $CO_2$ incorporated into the calcium overbased sulfurized alkylphenate provides for a $C_2$ to calcium weight ratio from between about 0.65:1 to about 0.73:1.

When a sulfurization catalyst is employed, it is typically employed at from about 0.5 to 10 weight percent to the alkylphenol in the reaction system and preferably at from about 1 to 2 weight percent. In a preferred embodiment, the sulfurization catalyst is added to the reaction mixture as a liquid. This can be accomplished by dissolving the sulfurization catalyst in molten sulfur or in the alkylphenol as a premix to the reaction.

The alkylphenol employed in this invention can either be branched or straight chain of at least about 10 carbon atoms and preferably from about 10 to about 30 carbon atoms. Preferably, the alkylphenol is prepared by reacting an appropriate olefin (or alkanol) or olefin (or alkanol) mixture with phenol in the presence of an acidic alkylating catalyst such as a sulfonic acid resin catalyst (e.g., Amberlyst TM 15 or 36) at a temperature of from about 60° C. to 200°C., preferably 110° C. to 180° C. and more preferably from 120° C. to 145° C. either neat or in an essentially inert solvent at atmospheric pressure. In the alkylation reaction, molar ratio of reactants may be used. Alternatively, molar excess of phenol can be employed, e.g., 2–2.5 equivalents of phenol for each equivalent of olefin or alkanol with unreacted phenol recycled. The latter process maximizes monoalkylphenol. Examples of inert solvents include benzene, toluene, chlorobenzene and Chevron 250 thinner (available from Chevron U.S.A., Inc., San Francisco, Calif.) which is a mixture of aromatics, paraffins and naphthenes.

The reaction to prepare the calcium overbased sulfurized alkylphenates of this invention also employs a $C_2$–$C_4$ alkylene glycol, preferably ethylene glycol, a high molecular weight alkanol (generally $C_8$ to $C_{16}$, e.g., decyl alcohol) and a compound selected from the group consisting of Group II metal neutral hydrocarbyl sulfonates and alkenyl succinimides.

The $C_2$–$C_4$ alkylene glycol is generally employed at a molar charge of about 1 to 4 per mole of alkylphenol, although preferably this molar charge is from about 1.8 to 3. Alternatively, 2-ethylhexanol may be employed in conjunction with the $C_2$–$C_4$ alkylene glycol at weight ratios such as 80% by weight 2-ethylhexanol and 20% by weight ethylene glycol.

The high molecular weight alkanol is employed at a molar charge of from about 0.5 to 5 per mole of alkylphenol, although preferably from about 0.5 to 4 and even more preferably from 1 to 2. Suitable alkanols of at least 8 carbon atoms include 1-octanol, 1-decanol (decyl alcohol), 2-ethylhexanol, and the like.

The Group II metal neutral hydrocarbyl sulfonates may be either natural or synthetic hydrocarbyl sulfonates such as petroleum sulfonate, synthetically alkylated aromatic sulfonates, or aliphatic sulfonates such as those derived from polyisobutylene. These sulfonates are well-known in the art. The hydrocarbyl group must have a sufficient number of carbon atoms to render the sulfonate molecule oil soluble. Preferably, the hydrocarbyl portion has at least 20 carbon atoms and may be aromatic or aliphatic, but is usually alkylaromatic. Most preferred for use are calcium, magnesium or barium sulfonates which are aromatic in character.

Certain sulfonates are typically prepared by sulfonating a petroleum fraction having aromatic groups, usually mono- or diakylbenzene groups, and then forming the metal salt of the sulfonic acid material. Other feedstocks used for preparing these sulfonates included synthetically alkylated benzenes and aliphatic hydrocarbons prepared by polymerizing a mono- or diolefin, for example, a polyisobutenyl group prepared by polymerizing isobutene. The metallic salts are formed directly or by metathesis using well-known procedures to provide for a neutral hydrocarbyl sulfonate having a TBN of no more than about 30.

When employed, the Group II metal neutral hydrocarbyl sulfonate is employed at from about 1 to 20 weight percent to the alkylphenol, although preferably from about 1 to 10 weight percent.

Alternatively, in lieu of a Group II metal neutral hydrocarbyl sulfonate, an alkenyl succinimide may be employed. Alkenyl succinimides are well-known in the art. The alkenyl succinimides are the reaction product of a polyolefin polymer-substituted succinic anhydride with an amine, preferably a polyalkylene polyamine. The polyolefin polymer-substituted succinic anhydrides are obtained by reaction of a polyolefin polymer or a derivative thereof with maleic anhydride. The succinic anhydride thus obtained is reacted with the amine compound. The preparation of the alkenyl succinimides has been described many times in the art. See, for example, U.S. Pat. Nos. 3,390,082; 3,219,666; and 3,172,892, the disclosure of which are incorporated herein by reference. Reduction of the alkenyl substituted succinic anhydride yields the corresponding alkyl derivative. The alkyl succinimides are intended to be included within the scope of the term "alkenyl succinimide". A product comprising predominantly mono- or bis-succinimide can be prepared by controlling the molar ratios of the reactants. Thus, for example, if one mole of amine is reacted with one mole of the alkenyl or alkyl substituted succinic anhydride, a predominantly mono-succinimide product will be prepared. If two moles of the succinic anhydride are reacted per mole of polyamine, a bis-succinimide will be prepared.

The alkenyl group of the alkenyl succinic anhydride is derived from an alkene, preferably polyisobutene, and is obtained by polymerizing an alkene (e.g., isobutene) to provide for a polyalkene which can vary widely in its compositions. The average number of carbon atoms in the polyalkene and hence the alkenyl substituent of the succinic anhydride can range from 30 or less to 250 or more, with a resulting number average molecular weight of about 400 or less to 3,000 or more. Preferably, the average number of carbon atoms per polyalkene molecule will range from about 50 to about 100 with the polyalkenes having a number average molecular weight of about 600 to about 1,500. More preferably, the average number of carbon atoms in the polyalkene molecule ranges from about 60 to about 90 and the number average molecular weight ranges from about 800 to 1,300. The polyalkene is reacted with maleic anhydride according to well-known procedures to yield the polyalkenyl substituted succinic anhydride which is referred to herein as the alkenyl substituted succinic anhydride.

In preparing the alkenyl succinimide, the substituted succinic anhydride is reacted with a polyalkylene polyamine to yield the corresponding succinimide. Each alkylene radical of the polyalkylene polyamine usually has up to about 8 carbon atoms. The number of alkylene radicals can range up to about 8. The alkylene radical is exemplified by ethylene, propylene, butylene, trimethylene, tetramethylene, pentamethylene, hexamethylene, octamethylene, etc. The number of amino groups generally, but not necessarily, is one greater than the number of alkylene radicals present in the amine, i.e., if a polyalkylene polyamine contains 3 alkylene radicals, it will usually contain 4 amino radicals. The number of amino radicals can range up to about 9. Preferably, the alkylene radical contains from about 2 to about 4 carbon atoms and all amine groups are primary or secondary. In this case, the number of amine groups exceeds the number of alkylene groups by 1. Preferably, the polyalkylene polyamine contains from 3 to 5 amine groups. Specific examples of the polyalkylene polyamines include ethylenediamine, diethylenetriamine, triethylenetetramine, propylenediamine, tripropylenetetramine, tetraethylenepentamine, trimethylenediamine, pentaethylenehexamine, tri(hexamethylene)tetramine, di(trimethylene)triamine), etc.

When employed, the amount of alkenyl succinimide used is from about 1 to 20 weight percent to the alkylphenol, although preferably from about 1 to 10 weight percent.

In a preferred embodiment, it has been found that the addition of a demulsifier such as Triton X-45 and Triton X-100 may synergistically enhance the hydrolytic stability of the Group II metal overbased sulfurized alkylphenate. Triton X-45 and Triton X-100 are nonionic detergents useful as demulsifiers and are available from Rohm and Haas (Philadelphia, Pa.). These demulsifiers are ethoxylated p-octylphenols. Other suitable demulsifiers include Igepal CO-610 available from GAF Corporation (New York, N.Y.). In one embodiment, the demulsifier and sulfurization catalyst are combined. That is, the aqueous solution contains calcium polysulfide and Triton X100. Such a product is sold by Chevron Chemical Company (San Francisco, Calif.) under the trade name of ORTHORIX®. Demulsifiers are generally added at from 0.1 to 1 weight percent to the alkylphenol, preferably at from 0.1 to 0.5 weight percent.

As noted above, a sufficient amount of a calcium overbased sulfurized alkylphenate composition so that the total base number of the formulated lubricating oil composition is from about 5 to 30 and preferably 10 to 20. Insofar as calcium overbased sulfurized alkylphenate compositions are prepared at TBN's of more than about 150, and preferably between about 200 and 300, only a small amount of this composition is required in the formulated railroad lubricating oil composition to meet the required TBN of this product. In a preferred embodiment, the calcium overbased sulfurized alkylphenate composition is employed at from about 2 to about 15 weight percent, and preferably from about 4 to 10 weight percent, based on the total weight of the formulated railroad lubricating oil composition.

The oils which find use in this invention are oils of lubricating viscosity derived from petroleum or synthetic sources, which preferably provide for a 40 SAE viscosity grade lubricating oil composition. Oils of a 40 SAE lubricating viscosity normally have viscosities in the range of 12.5 cSt to 16.7 cSt at 100°C., and more usually from about 13.7 to 15.7 cSt at 100° C. Examples of such base oils are naphthenic base; paraffin bases; mixed-base mineral oils; and synthetic oils, for example, alkylene polymers such as polymers of propylene, butylene, etc.; and mixtures thereof.

Usually included in the oils besides the subject wear inhibitor are additives such as dispersants/detergents, rust inhibitors, anti-oxidants, oiliness agents, foam inhibitors, viscosity index improvers, pour point depressants, etc. However, no zinc dithiophosphate is included in these lubricating oil compositions. Typical additives can include, by way of example, an alkenyl succinimides (as described above), and the like. Usually, the alkenyl succinimide is employed at an amount of from about 0.5 to 5.0 weight percent based on the total weight of the lubricating oil composition. When the lubricant composition does not contain a viscosity index improver, the composition is referred to as "single-grade". Lubricant compositions which contain a viscosity index improver are referred to as "multi-grade". Typically, a multi-grade lubricant composition contains from about 2 to about 8 weight percent of a viscosity index improver.

In order to further illustrate the present invention and the advantages thereof, the following specific examples are given, it being understood that the same is intended only as illustrative and in no way limitative.

EXAMPLES

TERGITOL® additives were obtained from Union Carbide Chemicals and Plastics Company Inc., Danbury, Conn. The TERGITOL® 15-S-n additives are a mixture of linear secondary alcohols reacted with ethylene oxide having the general structure:

$$C_{11\text{-}15}H_{23\text{-}31}O[CH_2CH_2O]_nH$$

where n is the number of ethylene oxide units. TERGITOL® 24-L-45 is a linear alcohol containing 12 to 14 carbon atoms reacted with ethylene oxide and containing 6 ethylene oxide units.

SIPONIC® 218 was purchased from Alcolac, Baltimore, Md. SIPONIC® 218 has the following structure:

$$\text{iso-}C_{12}H_{25}\text{—S—}[CH_2CH_2O]_6H$$

Sorbitan monooleate was purchased from Quantum Chemical Corp., Emery Division, Baltimore, Md.

Example 1 below illustrates the synthesis of tetrapropenylphenol poly(oxyethylene) alcohol. Example 2 illustrates the 2-cycle railroad diesel engine test which was employed to test the lubricant compositions described herein. Examples 3–22 illustrate the compositions tested in Example 2 and their results.

Example 1

Synthesis of Tetrapropenylphenol Poly(oxyethylene) Alcohol

Tetrapropenylphenol was first prepared by adding 567 grams of tetrapropylene, 540 grams of phenol and 72 grams of a sulfonic acid cation exchange resin (polystyrene cross-linked with divinylbenzene) catalyst (Amberlyst 15® available from Rohm and Haas, Philadelphia, Pa.) to a 2-liter flask, equipped with stirrer, Dean-Stark trap, condensor and nitrogen inlet and outlet. The reaction mixture was heated to about 110° C. for about 3 hours with stirring under a nitrogen atmosphere. The reaction mixture was stripped by heating under vacuum and the resulting product filtered hot over diatomaceous earth to afford 626 grams of tetrapropenylphenol with a hydroxyl number of 205 and with 96% para-alkylphenol content.

A Fisher Porter Bottle with magnetic stirrer was charged with 70 grams (0.25 mole) of the tetrapropenylphenol prepared above and 2 grams (0.038 mole) of sodium methoxide. The vessel was flushed with nitrogen and heated to 160° C., and then placed under vacuum to remove the methanol. Once the methanol was eliminated as evidenced by the cessation of bubbling, 60 grams (1.38 moles) of gaseous ethylene oxide was added over a 4 hour period at 18 psi.

The crude product was then dissolved in chloroform and extracted three times with water. The organic layer was dried over anhydrous sodium sulfate and filtered. The solvent was removed to afford 18 grams of the desired product.

Example 2

Silver Wear Test

The effectiveness of each of the above additives was measured using the EMD 2-567 silver wear test. The EMD 2-567 test engine used for these evaluations had a D-1 type assembly. The D-1 configuration uses three chrome-plated and one ferrite-filled cast iron compression rings above the piston pin with one hooked scraper-type oil control ring and one ventilated case iron ring below the pin. The nominal compression ratio is 20:1. The test engine was kept in newly built condition by periodic replacement of the liners, pistons, rings, carriers, thrust washers, cam bearings, rods, rod bearings, main bearings, and reconditioned heads with new valves and rebuilt injectors.

For each silver wear test, the engine was thoroughly cleaned with a commercial petroleum-base solvent. The build-up consisted of new piston pins and special unleaded pin bearings. The pin bearings were weighed before and after the test. The piston pin diameters and in-carriers clearances were taken before and after the test. The crankcase and all oil lines were flushed with test oil, and the crankcase was charged to its full capacity of 45 U.S. gallons.

Each silver wear test included a full 9 hour and 20-minute EMD-type break-in. Following the break-in, the crankcase and air boxes were inspected for signs of bearing failure before the test phase was initiated. While under test, the engine was held at 835 rpm, 91±1.0 lbs/hr fuel rate and 6.8 inches of Hg air box pressure by a distributed digital process control computer. The water and oil inlet temperatures were controlled at 180°±2° F. and 210°±2° F., respectively. The fuel for these tests contained 0.1% sulfur and the cetane number was a nominal 47-50 No. 2 diesel.

At the conclusion of the test, the pin bearings were removed and rated according to the EMD distress demerit procedure. An average of 50 or less demerits with neither of the two bearings having 50 or more demerits is considered a passing result.

Examples 3–21

Silver Wear Test Compositions and Results

Lubricating oil samples were prepared by blending the candidate silver wear inhibiting additive to be tested with a formulated SAE 20W-40 oil containing 1.9 wt % of a conventional succinimide dispersant, 2.1 wt % of a conventional slightly basic calcium sulfonate, 3.3 wt % of a conventional sulfurized overbased calcium phenate having a TBN of about 250 and prepared in a manner similar to the method of U.S. Pat. No. 4,744,921 but without the addition of a sulfurization catalyst, 5.4 wt % of a conventional calcium phenolic amine, 0.7 wt % of a conventional terephthalic acid salt of a succinimide dispersant, 0.25 wt % of a conventional sulfurized molybdenum succinimide complex, 0,049 wt % of a conventional cosulfurized alkyl ester/alpha olefin, and about 4 to 4.7 (e.g., 4.3 weight percent) of a conventional aminated ethylene propylene olefin copolymer VI improver; or by blending the additive to be tested with a formulated SAE 40 oil containing the above additives except for the VI improver (provides for a single-grade oil rather than a multigrade oil).

Nineteen lubricating oil samples (Examples 3–21) were prepared and tested in the EMD 2–567 silver wear test described above. The results are shown in Table I below.

As can be seen from the results of these examples illustrated in Table I, certain polyoxyalkylenes are effective inhibitors of silver wear when used in lubricating oil compositions for two-cycle railroad diesel engines containing silver wrist pin bearings. The results of this test also demonstrate that the inclusion of a polyoxyethylated derivative in a multi-grade formulation results in inconsistent silver wear inhibition including failures in this test (e.g., examples 4, 6, 8, 9, 10, 13, 14 and 21). However, some of the polyoxyethylated derivatives provided consistent passing results in both a single grade and a multigrade lubricating oil (e.g., examples 16-20). In all cases, formulation of a polyoxyethylated derivative in a single grade oil resulted in a passing grade.

TABLE I

| | | SILVER WEAR TEST RESULTS | | | | | | |
|---|---|---|---|---|---|---|---|---|
| Ex. | | No. of EO | Add | | Lub. Oil | Bearing Demerits | | |
| No. | Additive | Units[1] | Wt. % | Type[2] | Grade | Left | Right | Pass |
| 3 | None | — | — | — | 20W-40 | 440.0 | 444.0 | No |
| 4 | Example 1[3] | 5 | 0.6 | B | 20W-40 | 440.0 | 440.0 | No |
| 5 | Example 1[4] 1st Run | 5 | 0.6 | B | 40 | 22.0 | 22.0 | Yes |
| 6 | Example 1[5] 2nd Run | 5 | 0.6 | B | 40 | 53.0 | 143.0 | No |
| 7 | Example 1[6] 1st Run | 5 | 1.0 | B | 20W-40 | 48.0 | 27.0 | Yes |
| 8 | Example 1[7] 2nd Run | 5 | 1.0 | B | 20W-40 | 104.0 | 21.5 | No |
| 9 | TERGITOL 15-S-5 | 5 | 0.6 | L | 20W-40 | 130.0 | 440.0 | No |
| 10 | TERGITOL 15-S-7 | 7 | 0.6 | L | 20W-40 | 94.0 | 130.0 | No |
| 11 | TERGITOL 15-S-7 | 7 | 1.0 | L | 20W-40 | 18.5 | 22.0 | Yes |
| 12 | TERGITOL 15-S-7 | 7 | 1.0 | L | 40 | 9.0 | 15.0 | Yes |
| 13 | TERGITOL 15-S-9, 1st run | 9 | 0.6 | L | 20W-40 | 440.0 | 91.0 | No |
| 14 | TERGITOL 15-S-9, 2nd run | 9 | 0.6 | L | 20W-40 | 54.5 | 26.5 | No |
| 15 | TERGITOL 15-S-9 | 9 | 0.6 | L | 40 | 27.0 | 19.5 | Yes |
| 16 | TERGITOL 15-S-12, 1st run | 12 | 0.6 | L | 20W-40 | 19.0 | 16.0 | Yes |
| 17 | TERGITOL 15-S-12, 2nd run | 12 | 0.6 | L | 20W-40 | 22.0 | 25.0 | Yes |
| 18 | TERGITOL 15-S-12, 1st run | 12 | 0.6 | L | 40 | 19.0 | 12.0 | Yes |
| 19 | TERGITOL 15-S-12, 2nd run | 12 | 0.6 | L | 40 | 18.0 | 13.0 | Yes |

TABLE I-continued

| Ex. No. | Additive | SILVER WEAR TEST RESULTS No. of EO Units[1] | Add Wt. % | Type[2] | Lub. Oil Grade | Bearing Demerits Left | Right | Pass |
|---|---|---|---|---|---|---|---|---|
| 20 | TERGITOL 24L-45 | 6 | 1.0 | L | 20W-40 | 29.0 | 17.5 | Yes |
| 21 | Siponic 218 | 10 | 0.6 | B | 20W-40 | 159.0 | 440.0 | No |

[1]Number of ethylene oxide units in additive.
[2]Alcohol type: B = Branched; L = Linear
[3]Preparation 1 is Tetrapropenylphenyl Poly(oxyethylene) Alcohol
[4]Preparation 1 is Tetrapropenylphenyl Poly(oxyethylene) Alcohol
[5]Preparation 1 is Tetrapropenylphenyl Poly(oxyethylene) Alcohol
[6]Preparation 1 is Tetrapropenylphenyl Poly(oxyethylene) Alcohol
[7]Preparation 1 is Tetrapropenylphenyl Poly(oxyethylene) Alcohol Additionally, the polyoxyethylated derivatives showed inconsistent solubility and compatibility when tested for these characteristics in multi-grade lubricating oil compositions formulated for two-cycle railroad diesel engines. However, such solubility and/or compatibility problems were overcome by either employing a single grade oil or by employing a copolymer of oxyethylene/oxypropylene using a ratio of about 1:1 oxyethylene to oxypropylene units.

In either event, the polyoxypropylene and higher derivatives will not exhibit solubility and/or compatibility problems in multi-grade oils as evidenced by the above results. While it is uncertain as to why the polyoxyethylene derivatives did not provide consistent engine test results in a multi-grade oil, it is possible (without being limited to any theory) that the solubility and/or compatibility problems of these derivatives in a multi-grade oil may play some role in these results. Accordingly, it is contemplated that the polyoxypropylene and higher derivatives will also provide consistent and passing results for silver wear inhibition. In this latter regard, it is noted that Example 22 below illustrates that the use of a composition containing a glycidol derivative of n—$C_{18}H_{37}$—SH provides for significantly superior passing results in the engine test of Example 2.

Example 22

Glycidol Derivative of n—$C_{18}H_{37}$—SH as a Silver Wear Inhibitor

Glycidol derivatives of n—$C_{18}H_{37}$—SH are known in the art and are described, for example, in U.S. Pat. Nos. 4,394,276, 4,394,277, and 4,384,967, the disclosures of which are incorporated herein by reference in their entirety. In the present case, the glycidol derivative of n—$C_{18}H_{37}$—SH was prepared as follows:

To a 3 liter, 3-neck flask equipped with a stirrer, a nitrogen inlet, dropping funnel and condenser was added 499 grams (1.741 moles) of octadecyl mercaptan (n—$C_{18}H_{37}$—SH which is commercially available, e.g., Aldrich Chemical Company, Inc., Milwaukee, Wis.). The octadecyl mercaptan was melted under nitrogen while stirring (when mechanically possible) by heating to a temperature of about 75° C. At this point, 128.7 grams (1.737 moles) of glycidol in 130 milliliters of tetrahydrofuran was added over about a 1.5 hour period while maintaining the reaction temperature at approximately 75° C. during the first 55 minutes of addition. At this point, the temperature rose to about 110° C. during the next 10 minutes whereupon the heat source was removed. The temperature then was allowed to drop and reached about 90° C. at the conclusion of the addition.

After completion of the glycidol addition, the reaction system was stirred for about 135 minutes while maintaining the temperature between about 80° C. and 90° C. A sample of the product was removed and the tetrahydrofuran evaporated. Fourier transfer infrared spectroscopy of this sample indicated no epoxide present in the reaction mixture.

An additional 4.9 grams of glycidol in 5 milliliters of tetrahydrofuran was then added and the reaction mixture stirred for about an additional 2.5 hours at approximately 80° C. Thereupon, another 4.9 gram sample of glycidol in 5 milliliters of tetrahydrofuran was added under the same conditions as recited above.

The reaction was then stopped and the tetrahydrofuran removed by stripping to provide for 640 grams of the glycidol derivative of octadecyl thiol. The crude product was then hot filtered (at about 95° C.) through a 50/50 Celite® 512/545 mixture (available from Manville Corp.) which was heated with a heat lamp and heat gun to maintain the hot filter conditions.

The stoichiometry of the reaction (use of about 1 equivalent of glycidol per equivalent of octadecyl thiol) favors the formation of a preponderance of the n—$C_{18}H_{37}SCH_2CHOHCH_2OH$ and the n—$C_{18}H_{37}SCH(CH_2OH)_2$ products.

The resulting product was added to a formulated SAE 20W-40 oil to provide 1 weight percent of this additive to the oil. The formulated oil contained 1.9 wt % of a conventional succinimide dispersant, 2.1 wt % of a conventional slightly basic calcium sulfonate, 3.3 wt % of a conventional sulfurized overbased calcium phenate having a TBN of about 250 and prepared in a manner similar to the method of U.S. Pat. No. 4,744,921 but without the addition of a sulfurization catalyst, 5.4 wt % of a conventional calcium phenolic amine, 0.7 wt % of a conventional terephthalic acid salt of a succinimide dispersant, 0.25 wt % of a conventional sulfurized molybdenum succinimide complex, 0.049 wt % of a conventional cosulfurized alkyl ester/alpha olefin, and about 4.0 to 4.7 (e.g., 4.3) weight percent of a conventional aminated ethylene propylene olefin copolymer VI improver.

This formulated multi-grade oil was then employed in the silver wear test of Example 2 as described above. The bearing demerits resulting from the use of this oil composition in the silver wear test of Example 2 are set forth in Table II:

TABLE II

| Additive | Bearing Demerits Left | Right |
|---|---|---|
| Example 22 | 12 | 7 |

The results of this example demonstrate that the additive of Example 22 provides excellent silver wear inhibition in a two cycle railroad diesel engine.

Other embodiments of the invention will be apparent to those skilled in the art from consideration of the specification and practice of the invention disclosed herein. It is intended that the specification and examples be considered as exemplary only, with the true scope and spirit of the invention being indicated by the following claims.

What is claimed is:

1. A method for inhibiting wear of silver wrist-pin bearings in a two-cycle railroad diesel engine which method comprises lubricating the internal portion thereof with a lubricating oil composition which consisting essentially of:

a single or multi-grade oil of lubricating viscosity;

a sufficient amount of a calcium overbased sulfurized alkylphenate composition so that the total base number in the lubricating oil composition is from about 5 to about 30; and a wear-inhibiting amount of at least one lubricating oil soluble and compatible compound selected from the group consisting of compounds of formula I $$R—X—[(R_1O—)_nH]_m \quad \text{I}$$

of formula II $$R—X—CH_2\overset{\overset{\displaystyle OH}{|}}{C}HCH_2OH \quad \text{II}$$

of formula III $$R—X—CH\begin{cases} CH_2OH \\ CH_2OH \end{cases} \quad \text{III}$$

and products obtained by reacting the compounds of formula II and III with from 1 to 30 equivalents of a compound selected from the group consisting of alkylene oxide of from 2 to 6 carbon atoms, glycidol and mixtures thereof under conditions resulting in formation of an alkylene oxide and/or glycidol adduct of the compounds of formula II and III wherein R is a hydrocarbyl radical having from about 4 to about 50 carbon atoms; $R_1$ is independently an alkylene group of from about 2 to about 6 carbon atoms; X is selected from the group consisting of oxygen, sulfur and nitrogen; n is an integer from 1 to about 30 m is 1 when X is oxygen or sulfur and is 1 or 2 when X is nitrogen; and with the proviso that when $R_1$ is ethylene, then the oil of lubricating viscosity is a single grade oil.

2. The method according to claim 1 wherein R is a hydrocarbyl radical having from about 6 to about 20 carbon atoms.

3. The method according to claim 1 wherein R is an aralkyl hydrocarbyl radical.

4. The method according to claim 1 wherein R is an alkyl radical.

5. The method according to claim 4 wherein the alkyl group contains a secondary or tertiary carbon atom at the carbon atom attached to X.

6. The method according to claim 1 wherein the silver wear inhibiting compound is a compound of formula I and $R_1$ is an alkylene radical having from 2 to 4 carbon atoms.

7. The method according to claim 6 wherein $R_1$ is ethylene and R is an alkyl radical containing a secondary or tertiary carbon atom attached to the X group.

8. The method according to claim 7 wherein the carbon atom of the alkyl group attached to X is a tertiary carbon atom.

9. The method according to claim 1 wherein X is oxygen,

10. The method according to claim 9 wherein n is between about 10 and about 20.

11. The method according to claim 8 wherein the lubricating oil soluble and compatible silver wear inhibiting compound comprises a mixture of compounds of the general formula $$C_{11\text{-}15}H_{23\text{-}31}O(CH_2CH_2O)_nH$$

wherein n is an integer from about 10 to 20,

12. The method according to claim 11 wherein n is 12.

13. The method according to claim 1 wherein the lubricating oil soluble and compatible silver wear inhibiting compound is a compound of either formula II or III, 14. The method according to claim 1 wherein the lubricating oil soluble and compatible silver wear inhibiting compound comprises between about 0.1 and about 5.0 weight percent of the lubricating oil composition, 15. The method according to claim 14 wherein the lubricating oil soluble and compatible silver wear inhibiting compound comprises between about 0.3 and about 1.0 weight percent of the lubricating oil composition, 16. The method according to claim 1 wherein the lubricating oil composition has a total base number (TBN) of from about 10 to about 20.

17. The method according to claim 1 wherein said oil of lubricating viscosity of from about 12.5 cSt to 16.7 cSt at 100° C.

* * * * *